US007913324B2

(12) United States Patent
Groves et al.

(10) Patent No.: US 7,913,324 B2
(45) Date of Patent: Mar. 29, 2011

(54) HEADPIECE

(76) Inventors: Joseph Eric Groves, Granger, IA (US); Ryan Eric Parlee, Altoona, IA (US)

( * ) Notice: Subject to any disclaimer, the term of this patent is extended or adjusted under 35 U.S.C. 154(b) by 0 days.

(21) Appl. No.: 12/369,038

(22) Filed: Feb. 11, 2009

(65) Prior Publication Data

US 2010/0199408 A1 Aug. 12, 2010

(51) Int. Cl.
*A42B 1/04* (2006.01)

(52) U.S. Cl. ..... 2/171; 2/200.3; 2/12

(58) Field of Classification Search ..... 2/171, 171.03, 2/200.3, 12, 195.2; 446/27
See application file for complete search history.

(56) References Cited

U.S. PATENT DOCUMENTS

| | | | | |
|---|---|---|---|---|
| 2,795,796 | A * | 6/1957 | Ray | 2/206 |
| 3,184,757 | A * | 5/1965 | Pennington | 2/171 |
| 6,910,225 | B2 * | 6/2005 | Kovalenko | 2/200.3 |
| 6,941,582 | B2 * | 9/2005 | Miska | 2/200.3 |

* cited by examiner

*Primary Examiner* — Gary L Welch
*Assistant Examiner* — Alissa J Tompkins

(57) ABSTRACT

A headpiece having a first section and a second section separated along a fold-line. The sections have a decorative design printed thereon and are cut from a piece of material such that a top edge and bottom edge have the shape of the decorative design. The first section has a tab extending from the top edge that is received within a slit on the second section. A strap extends outwardly from the side edge of the second section and has at least one slit that receives a tab that extends outwardly from the side edge of the first section.

10 Claims, 2 Drawing Sheets

HEADPIECE

BACKGROUND OF THE INVENTION

This invention is directed toward a headpiece, and more particularly to a novelty headpiece.

Novelty headpieces are known in the art. While these devices allow schools and organizations to support and promote their teams and products, these devices are complex in their construction, having many parts and pieces, are difficult to adapt from one group to another, and are generally cost prohibitive. As a result, a need exists in the art for a device that addresses these deficiencies.

Therefore, an object of the present invention is to provide a headpiece that is of simple, one-piece construction that is easy to assemble.

Another object of the present invention is to provide a headpiece that is easy to adapt from one organization to another.

A still further objective is to provide a headpiece that is cost effective to produce.

These and other objectives will be apparent to one of ordinary skill in the art based on the following written description, figures, and claims.

BRIEF SUMMARY OF THE INVENTION

A headpiece having a first section and a second section separated along a fold-line. The sections have a decorative design printed thereon and are cut from a piece of material such that a top edge and bottom edge have the shape of the decorative design. The first section has a tab extending from the top edge that is received within a slit on the second section. A strap extends outwardly from the side edge of the second section and has at least one slit that receives a tab that extends outwardly from the side edge of the first section.

DETAILED DESCRIPTION OF THE PREFERRED EMBODIMENT

Figure 1:
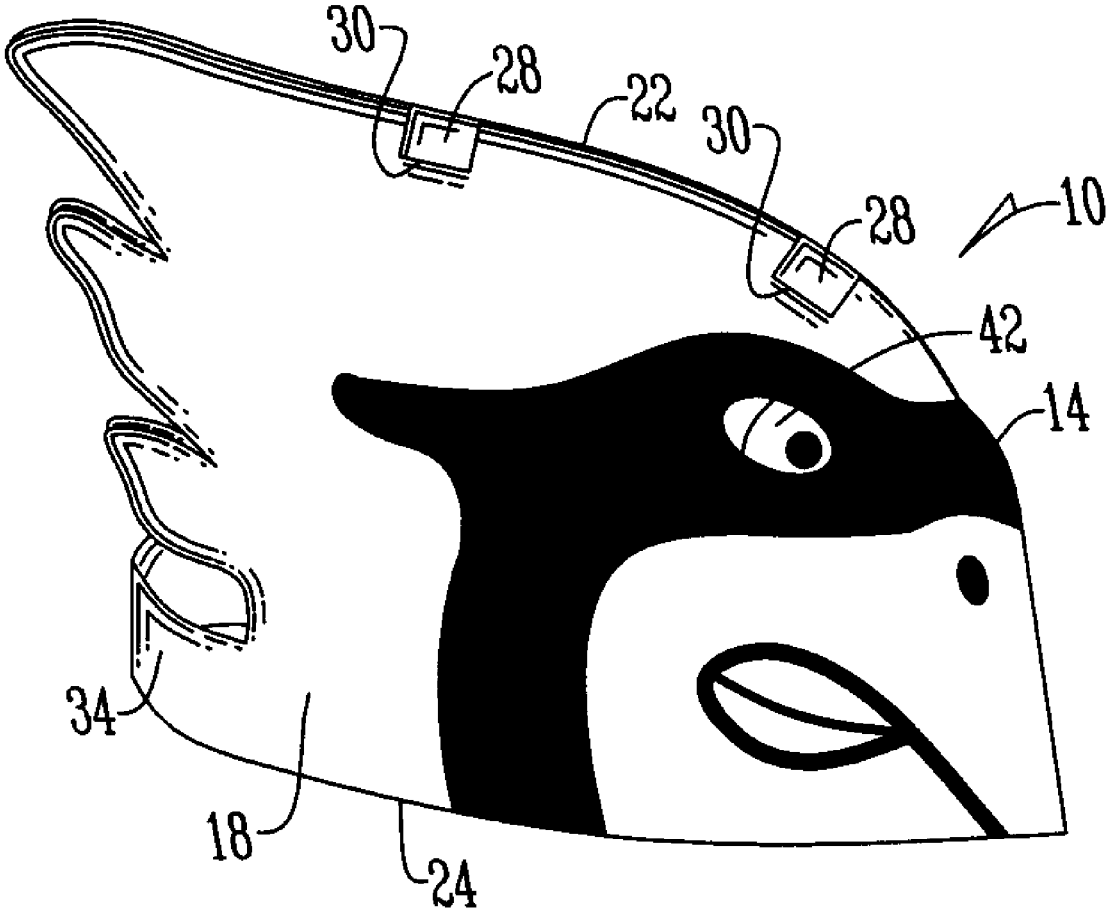
FIG. 1 is a perspective view of a headpiece.

Referring to the figures, the headpiece 10 is cut or blanked out of a rectangular sheet 12 of material. Preferably, multiple headpieces 10 can be cut out of a single sheet 12 depending upon the shape and design of the headpiece 10. The material can be of any type but preferably is made of a plastic, cardboard, or heavy paper stock. Prior to cutting, a decorative design 14 is printed on the rectangular sheet 12. The decorative design 14 is of many types including college and high school mascots and emblems, professional sports team mascots or emblems, animals such as those in a zoo, symbols or designs for corporate products, and the like. As an example, the decorative design 14 shown in the figures is that of a cardinal.

The decorative design 14 has a first section 16 and a second section 18 that are separated by at least one fold-line 20. Both the first section 16 and the second section 18 have a first or top edge 22, a second or bottom edge 24, and a third or side edge 26. The top edge generally has a decorative shape based upon the decorative design 14. Extending outwardly from the top edge 22 of the first section 16 is at least one, and preferably a plurality of tabs 28. The tabs 28 are of any shape and size, but preferably are t-shaped.

Figure 2:
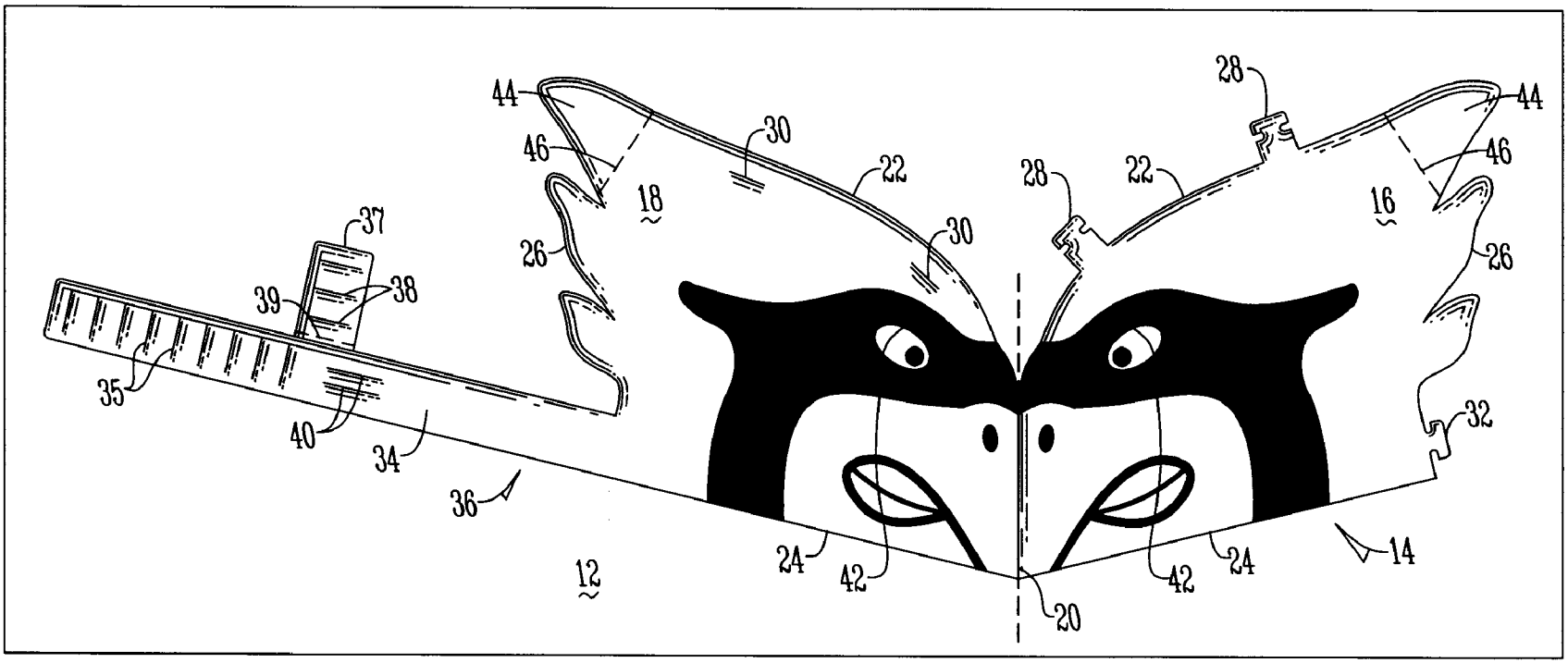
FIG. 2 is a top plan view of a headpiece.

Positioned inwardly from the top edge 22 of the second section 18 is at least one, and preferably a plurality of slits 30 that are formed to receive tabs 28 when the headpiece 10 is folded along fold-line 20. The slits 30 are positioned on the second section 18 such that they align with the tabs 28 when the headpiece 10 is folded. The bottom edge 24 of both the first section 16 and second section 18 is either straight or can be decoratively shaped based upon the decorative design 14. Generally, regardless of the shape, the bottom edge 24 of both the first section 16 and the second section 18 angles upwardly from the fold-line 20 toward the top edge 22 as shown in FIG. 2.

Adjacent the bottom edge 24 of the first section 16 and extending outwardly from the side edge 26 of the first section is a connecting tab 32. The connecting tab 32 is of any size and shape, but preferably is t-shaped. Forming part of the bottom edge 24 and extending outwardly from the side edge 26 of the second section 18 is a strap 34. The strap 34 has at least one and preferably a plurality of transverse slits 35 that are positioned to receive the connecting tab 32 such that the strap 34 fits around and is secured to an individual's head. Multiple slits 35 are positioned in spaced alignment along the strap 34 so that the headpiece 10 is adjustable for different sizes of heads. In one embodiment, the strap has a decorative design such as a sponsor's logo that when assembled is positioned at the back of a user's head and is cut to form a decorative shape. The connecting tab 32 and strap 34 are generally referred to as a fastening member 36. While a strap 34 and tab 32 is the preferred means of attachment, other fastening members 36 such as a string that is tied, a hook and loop system, or the like may be used.

Removeably attached to the strap is a card 37 having printed indicia 38. The card 37 can provide school information such as a team's schedule, can include a player's picture and statistics and be used as a trading card, or could be a coupon for a discount on a product for a company or sponsor. Preferably the card 37 is attached to the strap 34 along a perforated cut-line 39. Also, along the strap are printed promotional indicia 40 of a sponsor.

Portions 42 of both the first section 16 and second section 18 are cut such that the portions extend or pop out from the planer surface of each respective section. For example, the eyes of the cardinal in the Figures could be cut such that they would extend out from the uncut portion of the section. Also, portions 44 of the decorative design can have additional fold-lines 46 that permit the portions to be folded and shaped giving the headpiece an additional distinctive look.

To create the headpiece 10, first the rectangular sheet 12 is printed with a decorative design 14. Once printed, the decorative design 14 is cut or blanked out of the rectangular sheet 12 such that the top edge 22, the bottom edge 24, and the side edge 26 take on the decorative shape of the design 14 and also includes the tabs 28 and 32, the strap 34, and the slits 30 and 35. Once cut, the headpiece is folded along fold-line 20 and tabs 28 are inserted into slits 30 to connect the top edge of the first section 16 and the second section 18. Any portions 42 are then pulled out and portions 44 are folded along fold-lines 46 to provide shaping for an additional distinctive look. Finally, strap 34 is folded such that tab 32 is inserted into slit 35 to fit snugly around an individual's head.

A headpiece 10 has been disclosed that at the very least meets all the state objectives.

What is claimed is:

1. A headpiece comprising:

a first section and a second section separated along at least one fold-line and having a decorative design printed on the sections;

the first section having at least one tab extending outwardly from a top edge of the first section and at least a tab extending outwardly from a side edge of the first section;

the second section having at least one slit inward of the top edge of the second section and positioned to receive the tab extending from the top edge of the first section to connect the top edge of the first section and the top edge of the second section;

a fastening member that extends outwardly from a side edge of the second section having at least one slit positioned to receive the tab extending outwardly from the side edge of the first section, wherein the fastening member is an elongated strap forming part of a bottom edge of the second section; and wherein the headpiece is formed of a single sheet of material.

2. The headpiece of claim 1 wherein the top edge of the first and the second section has a shape of the decorative design.

3. The headpiece of claim 1 wherein the side edges of the first and second sections has a shape of the decorative design.

4. The headpiece of claim 1 wherein a bottom edge of both the first and second section has a shape of the decorative design.

5. The headpiece of claim 1 wherein a portion of the first and the second sections are cut and pop out from a planar surface of each section.

6. The headpiece of claim 1 wherein a portion of the decorative design is folded along a fold-line to permit the decorative design to be shaped.

7. The headpiece of claim 1 wherein a card having printed indicia is removably attached to the fastening member.

8. The headpiece of claim 1 wherein the elongated strap has a plurality of transverse slits.

9. The headpiece of claim 8 wherein the plurality of transverse slits are positioned to receive the tab extending outwardly from the side edge of the first section.

10. The headpiece of claim 8 wherein the plurality of transverse slits are positioned in parallel spaced alignment so that the headpiece is adjustable for different sizes of heads.

* * * * *